US006151800A

United States Patent [19]

Kerr et al.

[11] Patent Number: 6,151,800

[45] **Date of Patent: *Nov. 28, 2000**

[54] COVER FOR THE UPPER OF A DANCE SHOE

[76] Inventors: Karen Kathleen Kerr, 215 Blair St.; Judy Gradwohl Bingler, 168 Blair St., both of Johnstown, Pa. 15905

[ * ] Notice: This patent issued on a continued prosecution application filed under 37 CFR 1.53(d), and is subject to the twenty year patent term provisions of 35 U.S.C. 154(a)(2).

[21] Appl. No.: 09/086,562

[22] Filed: May 29, 1998

[51] Int. Cl.[7] ..... A43B 5/12; A43B 3/20

[52] U.S. Cl. ..... 36/8.3; 36/7.2; 36/7.4

[58] Field of Search ..... 36/7.1 R, 8.3, 36/101, 72 R, 7.2, 7.4, 2 R

[56] References Cited

U.S. PATENT DOCUMENTS

| | | | |
|---|---|---|---|
| D. 290,540 | 6/1987 | Anderson | D2/264 |
| 2,013,700 | 9/1935 | Savale | 36/100 X |
| 2,229,563 | 1/1941 | Greenstein | 36/72 R |
| 2,235,490 | 3/1941 | Saksa | 36/72 R |
| 2,438,711 | 3/1948 | Leach et al. | 36/101 |
| 2,901,842 | 9/1959 | De Lucia | 36/72 R |
| 3,477,147 | 11/1969 | Baue | 36/2 R |
| 3,994,080 | 11/1976 | Flanagan, Jr. et al. | 36/100 |
| 4,246,707 | 1/1981 | Pedersen | 30/100 |
| 4,489,509 | 12/1984 | Libit | 36/7.1 R |
| 5,083,385 | 1/1992 | Halford | 36/101 |
| 5,396,717 | 3/1995 | Bell | 36/7.3 |

*Primary Examiner*—Ted Kavanaugh
*Attorney, Agent, or Firm*—George C. Atwell

[57] ABSTRACT

A stretch-on elastic removable cover for a tap dance shoe enables the shoe to be decoratively transformed in appearance. The cover, when snugly fitted on the shoe, conforms to the shape of the shoe and conceals the shoe's upper. The cover is constructed to include an integral band which stretchably wraps under the shoe's arch, and an endless loop retaining wire partially contained within a curved sleeve integral to the forward or toe end of the cover and which encircles the perimeter of the shoe's toe tap.

2 Claims, 3 Drawing Sheets

COVER FOR THE UPPER OF A DANCE SHOE

BACKGROUND OF THE INVENTION

The present invention relates generally to accessories for dance costumes, and, more particularly, to removable shoe covers for dance shoes.

Dance is one of the most popular recreational activities engaged in by contemporary Americans of all ages, genders, and races. Dance in America runs the gamut from hip hop and country and western line dancing to elegant ballroom and retro '70's disco dancing. In addition, throughout the country, professional dance troupes and ballet companies flourish by their affiliation with schools, colleges and universities, cities, and regional arts councils. As recreation or as a competitive sport, dance uses the fundamentals of human movement to create an art form which is vivid, entertaining, and visually appealing.

Competitive dance is not only a sport; in recent decades it has also become a sizable and profitable business. Concomitant with the increase in sheer athleticism and technical skill and difficulty incorporated into the dance routines has been an increase in the cost, complexity, and ornateness of the costumes and sets. This is especially the case for individual dancers and dance troupes that enter dance competitions. In addition to the above-cited dance styles and forms, tap dancing still maintains its popularity throughout the country, and tap dance competitions are held nationwide.

Like a number of other competitive activies, one unpleasant drawback of dance—and especially of competitive dance—is the cost of outfitting the dancer, whether male or female. The artistry and imagination of contemporary dance costumes derives inspiration from the classics as well as from the vehicles of popular culture—television, movies, and music. Since each dance competition may have its own theme, in the course of a year, a competitive dancer may require anywhere from several to several dozen unique costumes. Dance costumes can range anywhere from $30.00 to $100.00 with the average being about $50.00. The cost of dance shoes may range between $15.00 and $100.00 while good quality tap shoes cost between $40.00 and $60.00. The larger clog-type tap shoes may cost up to $300.00. In addition, the cost of accessory items, such as jewelry, must also be added to the overall expense of outfitting a dancer.

There is a need to find ways to save money so that each costume, along with shoes and other accessory items, does not require a new outlay of money. Since the style, color, and design of the dance shoes, including tap dance shoes, are coordinated with the particular costume worn by the dancer, one way to reduce costume expenses is by providing a means whereby one pair of shoes can be used with a number of different costumes. The dance shoes would not be altered, but their external appearance would be changed by means of an accessory item, embodied in a variety of designs, that could be easily and quickly placed onto and over the dance shoes to harmonize the dance shoes with that respective costume. The same dance shoes could be used with a different costume; the external appearance would be harmonized with the new costume by use of an accessory item designed for the new costume.

The prior art discloses a number of items that fit onto or over shoes. U.S. Pat. No. 5,396,717 (Bell), U.S. Pat. No. 4,489,509 (Libit), U.S. Pat. No. 4,246,707 (Pedersen), U.S. Pat. No. 5,083,385 (Halford), and U.S. Design Pat. No. 290,540 (Anderson) all disclose over-shoe-type devices which are placed on or worn over shoes. U.S. Pat. No. 3,994,080 (Flanagan Jr. et al.) discloses a suede covering which can be snapped onto the saddle portion of a shoe. None of the above patents, however, disclose an accessory item which can be placed onto dance shoes, and quickly removed therefrom so that one pair of dance shoes can be adapted to harmonize with a variety of different dance costumes.

SUMMARY OF THE INVENTION

The present invention comprehends several embodiments for a shoe cover, each embodiment being removably securable to a shoe for covering the upper of the shoe. The shoe cover is primarily used with various styles of dance shoes, and especially tap dance shoes, in order to cover the upper of each style of dance shoe while allowing exposure of the heel and front sole portion adjacent the toe and, when used with the various styles of tap shoes, allowing exposure of the toe tap and the heel tap.

The several embodiments of the dance shoe cover each include a number of identical elements. The elements common to each embodiment are an upper covering portion for fully covering the upper of the various styles of dance shoes and a sole portion integral with the upper covering portion and extending generally about the periphery of the sole of each style of dance shoe. Furthermore, the several embodiments of the dance shoe cover include a rear heel aperture and a front opening for allowing projection therethrough of the heel and front sole adjacent the toe. When any of the embodiments of the dance shoe cover are used with tap style dance shoes, the rear heel aperture and front opening allow exposure of the heel tap and toe tap in addition to exposure of the heel and front sole portion adjacent the toe. Also, each of the embodiments of the dance shoe cover includes a flexible, metal or plastic, retaining or guide wire inserted into a sleeve attached to and integral with the peripheral portion of the sole encompassing the front opening. The wire also extends contiguous and transverse beneath the sole for maintaining the upper covering portion on the toe of the dance shoe and for preventing the upper covering portion and the sole portion from sliding onto and covering the sole of the dance shoe, and, when used with tap shoes, from sliding onto and covering the toe tap of the various styles of tap shoes.

It is an objective of the present invention to provide a dance shoe cover which is removably securable to various styles of dance shoes.

It is another objective of the present invention to provide several embodiments of a dance shoe cover, each of which has an aesthetic appearance which harmonizes with the particular costume worn by the dancer.

A further objective of the present invention is to provide several embodiments for the dance shoe cover, each of which is interchangeable with the various styles of dance shoes.

The above and other features, objects, and advantages of the present invention will become more apparent from the following description in which several embodiments of the invention are shown by way of illustrative examples.

DETAILED DESCRIPTION OF THE PREFERRED EMBODIMENTS

Illustrated in FIGS. 1–11 are several embodiments for a shoe cover that completely covers the shoe upper. The shoe covers shown in FIGS. 1–11 are adapted for use with dance shoes, with an especial emphasis for use with tap dance shoes. The various embodiments of the shoe cover are removably attachable to the various styles of tap dance shoes, and the dance shoe covers are designed is one-wire or unitized structures to be easily and quickly slipped onto and off of the various styles of dance shoes so that the particular dance shoe can be aesthetically harmonized with the costume worn by the dancer by wearing an appropriate dance shoe cover. If the dancer's routine requires several costume changes, the dancer can easily and quickly remove one style of dance shoe cover and slip onto his or her dance shoes the dance shoe covers which aesthetically harmonize with that respective costume. Thus, instead of investing in a number of costly pairs of dance shoes, with one pair of dance shoes corresponding to each costume the dancer may require during his or her yearly competitions, the dancer can use the same pair of dance shoes, or tap shoes, and make the less costly investment by obtaining the several styles of dance shoe covers. The external aesthetic appearance of the dance shoe covers can vary considerably and can include bows, sequins, beadwork, and innumerable color schemes. The easy attachment to and quick removal from the dance shoes is facilitated by the fact that the material from which the dance shoe covers are manufactured is a flexible, two-way stretch LYCRA composition. The LYCRA material from which the dance shoe covers are composed is the same material from which swimsuits are manufactured. LYCRA is the tradename for an elastic fiber manufactured by the Dupont Corporation and, like many other synthetic fibers, LYCRA comes in different stock and bonding weights and textures. In addition to the easy and quick attachment and removal of the dance shoe covers from the various styles of dance shoes, the various embodiments of dance shoe covers are interchangeable with the different styles of dance shoes. As a result, one respective embodiment for the dance shoe cover can be used with several styles of dance shoes and this helps to lower the overall cost of the dancer's full costume.

Figure 1:
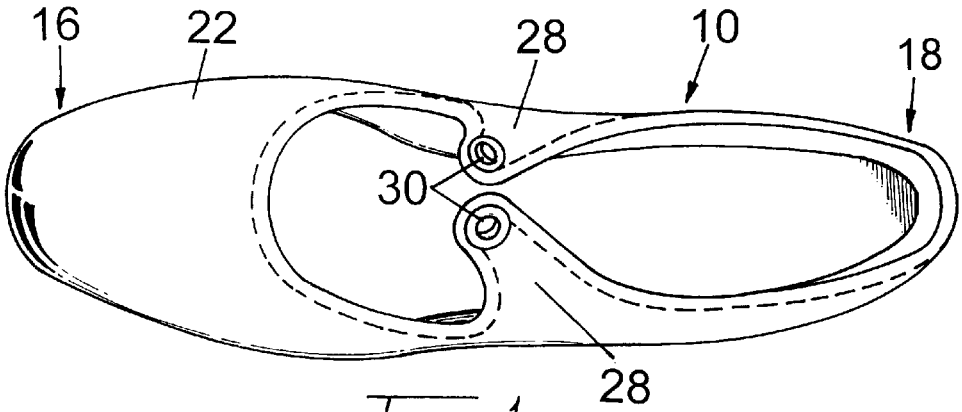
FIG. 1 is a top plan view of a tie-style dance shoe.
Figure 2:
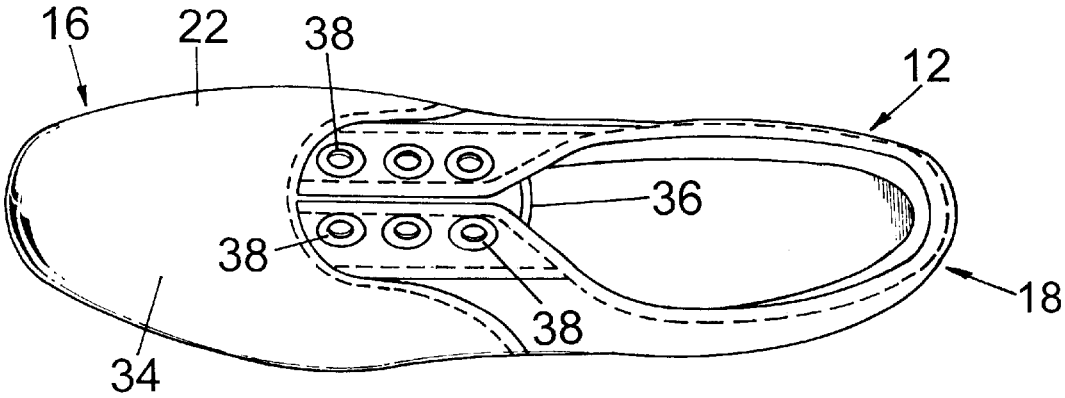
FIG. 2 is a top plan view of an Oxford-style dance shoe.
Figure 3:
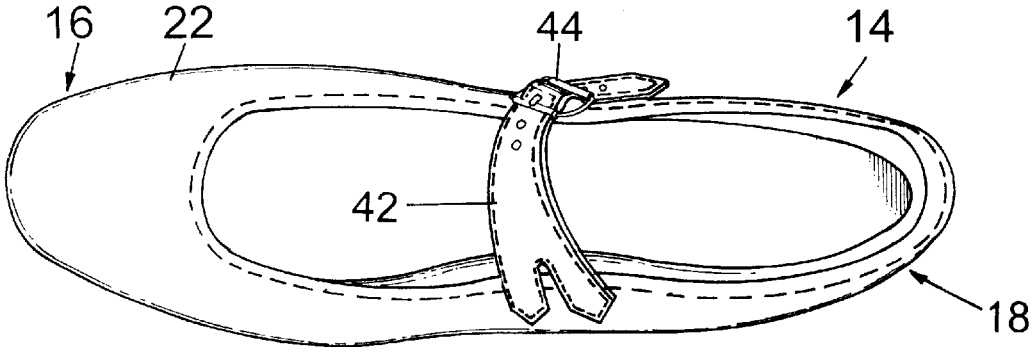
FIG. 3 is a top plan view of a Mary Jane-style dance shoe.
Figure 5:
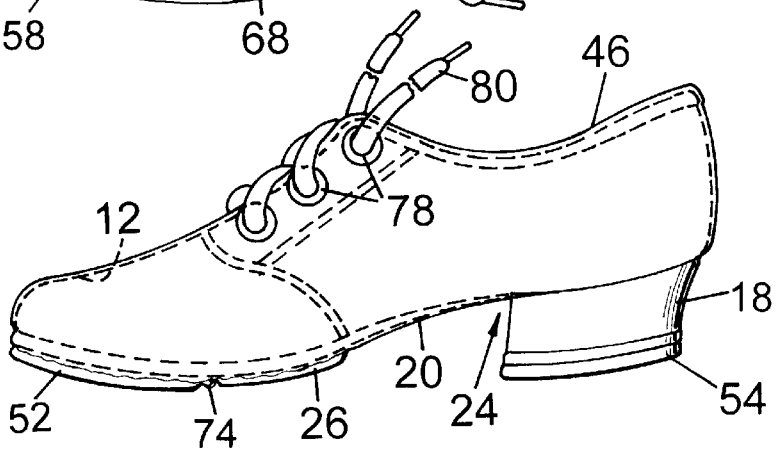
FIG. 5 is a side elevational view of the Oxford-style dance shoe cover disposed on an Oxford-style dance shoe shown in hidden line.
Figure 7:
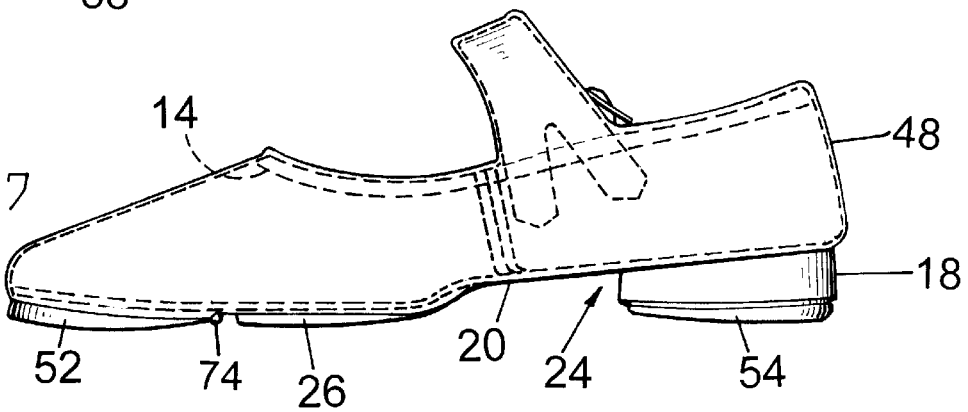
FIG. 7 is a side elevational view of the Mary Jane-style dance shoe cover disposed on a Mary Jane-style dance shoe shown in hidden line.
Figure 9:
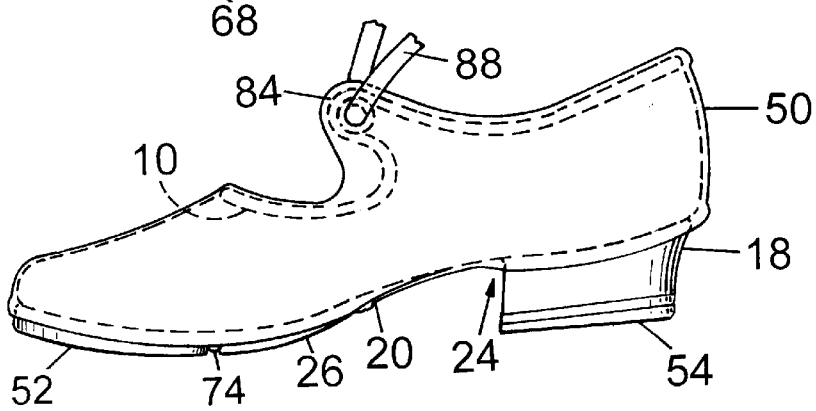
FIG. 9 is a side elevational view of the tie-style dance shoe cover disposed on a tie-style dance shoe shown in hidden line.

Illustrated in FIGS. 1–3 are the three primary styles of tap dance shoes. Illustrated in FIG. 1 is a tie-style shoe 10; in FIG. 2 is an Oxford-style dance shoe 12; and in FIG. 3 is a Mary Jane-style dance shoe 14. In addition, the tie shoe 10 is illustrated in FIG. 9 with a particular embodiment of dance shoe cover disposed thereon; the Oxford shoe 12 is shown in FIG. 5 with a particular embodiment of dance shoe cover disposed thereon; and the Mary Jane shoe 14 is shown in FIG. 7 with a particular embodiment of dance shoe cover disposed thereon. The various embodiments of the dance shoe covers will be fully described hereinafter. All three styles of dance shoes 10, 12, and 14 share a number of common features and structural elements. Each dance shoe 10, 12, and 14 includes a toe 16, an opposite heel 18 which may be flat or several inches in height, a sole 20 which extends from the toe 16 to the heel 18, and an upper 22, broadly described as all those parts of the dance shoes 10, 12, and 14 above the sole 20. In addition, each dance shoe 10, 12, and 14 includes a welt (not shown) which is a strip extending along the periphery of each dance shoe 10, 12, and 14 between the upper 22 and the sole 20 and by which the upper 22 and the sole 20 are stitched or stapled together. Also, each dance shoe 10, 12, and 14 includes an arch 24, which is that portion of the sole 20 adjacent the heel 18, and a rubber pad 26 which is attached to the sole 20 and is located forward of the arch 24 and heel 18.

With reference to FIGS. 1–3, 5, 7, and 9, the structural elements by which the dance shoes 10, 12, and 14 can be differentiated will now be set forth. With specific reference to FIGS. 1 and 9, the tie shoe 10 includes a pair of oppositely-disposed projecting portions 28 which are integral with each respective side of the upper 22 and, when tied together, lay on or above that portion of the dancer's foot adjacent to the dancer's ankle region. Each projecting portion 28 includes a grommet or an eyelet 30 through which a shoelace 32 can be inserted and tied for bringing the projecting portions 28 together.

As shown in FIGS. 2 and 5, the Oxford shoe 12 is like a regular shoe in that the Oxford 12 includes a vamp 34 which is the part of the upper 22. The Oxford 12 also includes a tongue 36 which also extends rearward and is disposed beneath the vamp 34. In addition, the Oxford 12 includes a plurality of pairs of grommets or eyelets 38 located on the vamp 34 and through which a shoelace 40 can be successively inserted for tying the Oxford 12.

As shown in FIGS. 3 and 7, the elements which differentiate the Mary Jane shoe 14 from the tie shoe 10 and Oxford shoe 12 are a strap 42 which extends from one side portion of the upper 22 to the opposite side portion of the upper 22 and a buckle 44 which is secured to one respective side portion of the upper 22 so that the strap 42 can be inserted through and held fast therein.

Figure 4:
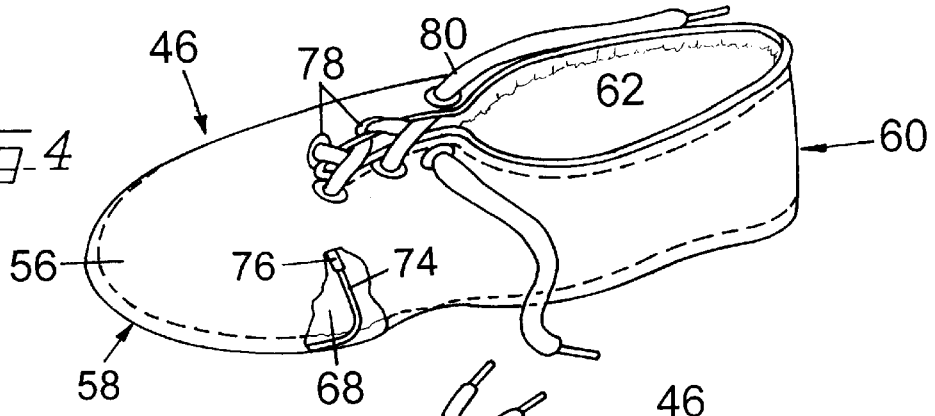
FIG. 4 is a perspective view of an Oxford-style dance shoe cover.
Figure 6:
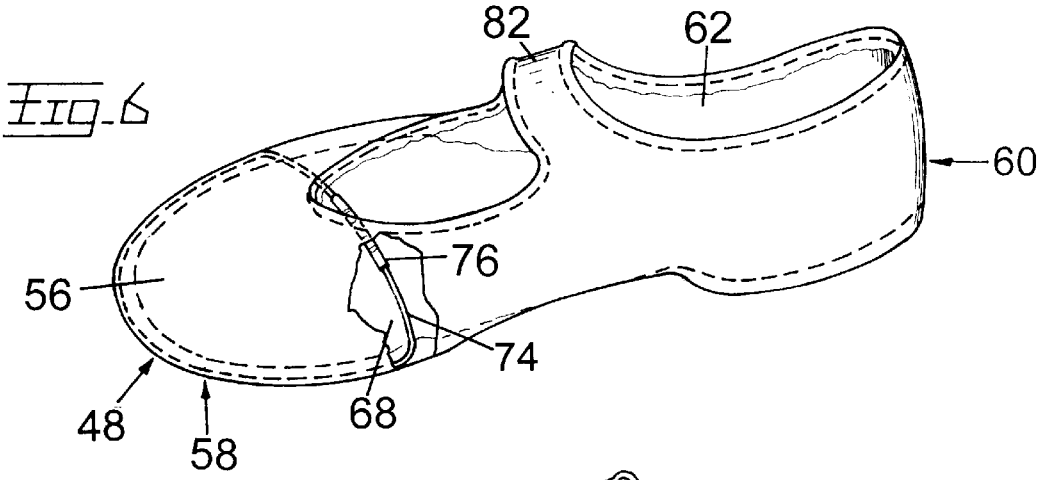
FIG. 6 is a perspective view of a Mary Jane-style dance shoe cover.
Figure 8:
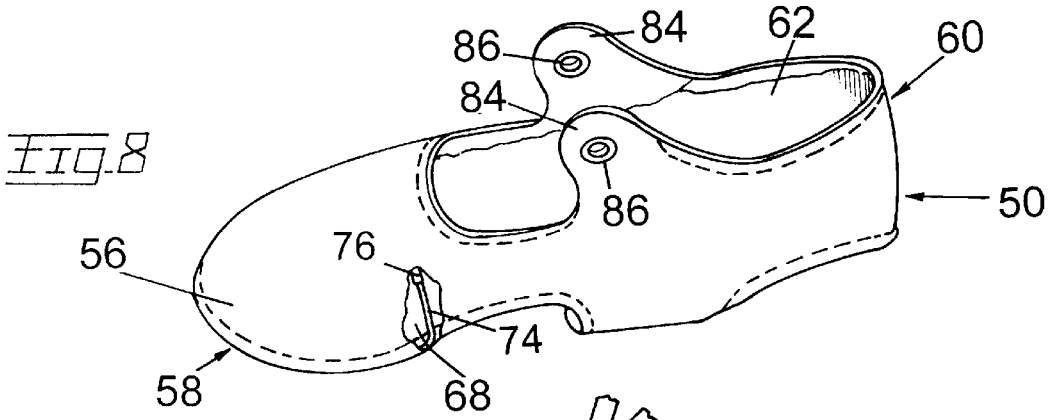
FIG. 8 is a perspective view of a tie-style dance shoe cover.

Illustrated in FIGS. 4–11 are the several embodiments for the dance shoe covers. Specifically, three embodiments for dance shoe covers are illustrated, and the design of each respective dance shoe cover resembles the particular style of the corresponding shoes 10, 12, and 14. Moreover, like the three primary styles of shoes 10, 12, and 14, the embodiments for the dance shoe cover have a number of common features or elements and a number of unique features and elements. Illustrated in FIG. 4 is an Oxford-style dance shoe cover 46; in FIG. 6 is a Mary Jane-style dance shoe cover 48; and in FIG. 8 is a tie-style dance shoe cover 50. FIG. 5 shows the Oxford cover 46 disposed on the Oxford shoe 12; FIG. 7 shows the Mary Jane cover 48 disposed on the Mary Jane shoe 14; and FIG. 9 illustrates a tie-style cover 50 disposed on the tie shoe 10. All three shoes 10, 12, and 14 include a toe tap 52 and a heel tap 54. For the purpose of clarifying the figures, the dotted lines of FIG. 4 are the stitching of the Oxford cover 46; the dotted lines of FIG. 5 are the Oxford shoe 12; the dotted lines of FIG. 6 are the stitching for the Mary Jane cover 48; the dotted lines of FIG. 7 are the Mary Jane shoe 14; the dotted lines of FIG. 8 are the stitching for the tie shoe cover 50; and the hidden lines for FIG. 9 are the tie shoe 10.

Figure 10:
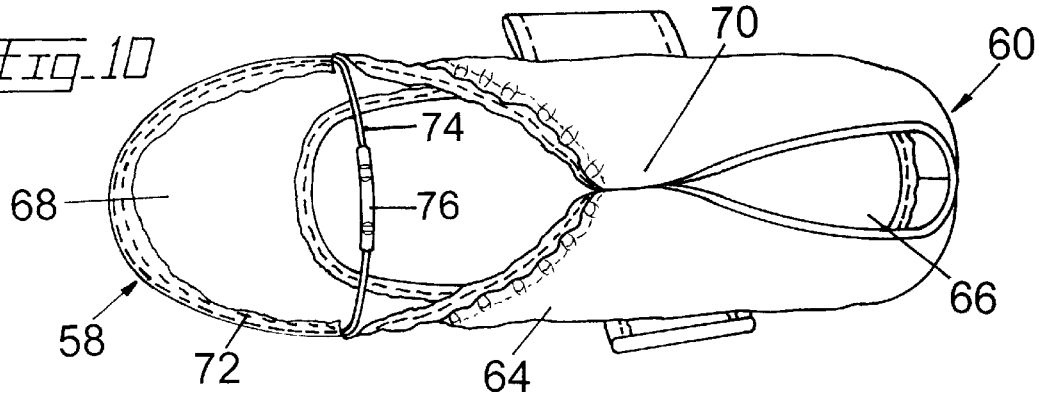
FIG. 10 is a bottom plan view of the Mary Jane-style dance shoe cover first shown in FIG. 6 illustrating the sole openings and the wire for holding the front of the dance shoe cover on the toe of a dance shoe, such as a Mary Jane-style dance shoe.

The elements common to the three covers 46, 48, and 50 are the following: a flexible and stretchable main body or upper covering portion 56 which fully and completely covers the upper 22. The upper covering 56 generally extends along the peripheral continuous line where the upper 22 meets the sole 20, and the upper covering 56 can be further delineated by a toe portion 58 and an opposite heel portion 60. In addition, the covers 46, 48, and 50 include an upwardly-opening foot hole 62 through which the dancer's foot and ankle are inserted in order for the dancer to place his or her foot within the respective shoe 10, 12, and 14. Another common element is a flexible and stretchable sole portion 64 which is integrally attached to the upper covering 56. The sole portion 64 generally extends along the periphery of the upper 22 at that point where the upper 22 is joined to the sole 20. As shown in FIG. 10, the sole portion 64 also includes a rear heel aperture 66 through which the heel 18 of the respective shoe 10, 12, and 14, and also the heel tap 54 when the shoes 10, 12, and 14 are used as tap dance shoes, is inserted for projecting therethrough and making contact onto the floor or dance surface, and a front sole or toe tap shoe opening 68 through which the front portion of the sole 20 projects for contacting the dance surface. When the toe tap 52 is mounted to the sole 20 adjacent the front portion thereof, the toe tap 52 will also project through front sole opening 68 for striking the dance surface or floor.

Furthermore, each embodiment for the dance shoe cover includes a flexible and stretchable integral bond potion 70. The intermediate bond portion 70 extends from one lower side of the upper covering 56 transverse and immediately beneath the sole 20 adjacent the area where the sole 20 and heel 18 meet to the opposite lower side of the upper covering 56. When each embodiment of the dance shoe cover is disposed on the respective dance shoe 10, 12, or 14, the bond portion 70 is taut in its extension beneath the sole 20.

Finally, each embodiment of the dance shoe cover includes a means for maintaining the disposition or placement of a front portion 58 of the upper covering 56 on the toe 16 of each respective shoe 10, 12, and 14 so that the upper covering 56 and the sole portion 64 do not slide onto and partially cover the sole 20 adjacent the toe 16 or, for shoes 10, 12, and 14 having taps 52 and 54, for preventing the upper covering 56 and sole portion 64 from being displaced, especially during the dance number, and sliding onto and partially or wholly covering the sole 20 and toe tap 52. Should the upper covering 56 and sole portion 64 become displaced during the dance routine and partially or wholly cover the toe tap 52, the dancer could lose his or her footing, falling unexpectedly upon the dance floor, with serious injury resulting.

Figure 11:
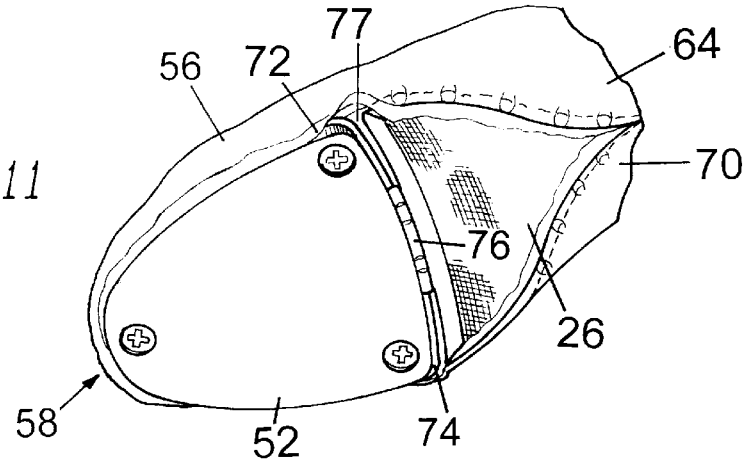
FIG. 11 is a perspective view of the wire and the front opening of the Mary Jane-style dance shoe cover first shown in FIG. 10 disposed on the Mary Jane-style dance shoe for allowing exposure of the toe tap.

With reference to FIGS. 5, 7, and 9–12, the means for maintaining the front portion 58 of the upper covering 56 on the toe 16 of the shoes 10, 12, and 14 is illustrated. When the toe tap 52 is secured by means of fasteners to the sole 20, a peripheral gap is formed between the tap 52 and the toe portion of the sole 20. A gap is also formed between the pad 26 and the tap 52. When the cover 46, 48, or 50 is placed on the shoe 10, 12, or 14, the front sole opening 68 will extend along the periphery formed by the attachment of the tap 52 to the front portion of the sole 20; however, the front portion 58 of the upper covering 56 has a tendency to slide on the toe 16 without the use of some retaining or holding means. Therefore, shown in FIGS. 5 and 7–11, is a means for firmly and snugly maintaining and holding the front portion 58 of the upper covering 56 onto the toe 16 so that the sole 20 and the tap 52 are not partially or wholly covered. The means for maintaining the front portion 58 of the upper covering 56 includes a sleeve 72 integrally attached to the upper covering 56 and extending in a semicircle adjacent the front and bottom of the upper covering 56. The sleeve 72 is a portion of the LYCRA material that is folded upon itself and stitched together so that a hollow and continuous recess is formed therein. Inserted into the sleeve 72 is a light and durable, metal or plastic, endless loops retaining or guide wire 74, a portion of which extends transversely across and beneath the sole 20 as shown in FIGS. 8, 10, and 11. The ends of the wire 74 are brought together beneath the sole 20 whereupon each wire end (not shown) is inserted into a cylindrical metal or plastic sleeve 76. The sleeve 76 is then crimped or pressed so that the ends of the wire 74 are held fast therein. When the dancer places any of the covers 46, 48, or 50 onto the shoes 10, 12, or 14, the wire 74 will snugly and securely fit within the gap formed by the tap 52, the pad 26, and the sole 20 with a portion of the wire 74 and the crimped sleeve 76 extending beneath and transverse to the front portion of the sole 20.

As shown in FIGS. 5, 7, 9, and 11, the exposed portions of the wire 74 and the sleeve 76 do not interfere with the movements of the dancer upon the floor surface because the wire 74 fits snugly within the gap 77 around the perimeter of the tap 12, and the thickness of the tap 52 prevents the exposed portions of the wire 74 and the sleeve 76 from touching the floor surface. It should be noted that in FIGS. 10 and 11 the Mary Jane cover 48 is used by way of example to illustrate the means for maintaining the disposition of the front sole opening 68 and front portion 58 of the upper covering 56, but the underside of the Oxford cover 46 and tie shoe cover 50 include the same elements.

Corresponding to the three primary styles of dance shoes 10, 12, and 14, with an especial emphasis on tap dance shoes, the elements that are unique to each of the covers 46, 48, and 50 will now be set forth. With reference to FIGS. 4 and 5, the Oxford cover 46 includes a plurality of grommets or eyelets 78 through which a shoelace 80 can be inserted for tying the Oxford cover 46 together once the Oxford cover 46 is placed upon the Oxford shoe 12. With regard to FIGS. 6 and 7, the Mary Jane cover 48 includes a strap 82 which extends from one side of the upper covering 56 and is attached to the opposite side of the upper covering 56. The strap 82 of the Mary Jane cover 48 will cover the strap 42 and buckle 44 of the Mary Jane shoe 14. With regard to FIGS. 8 and 9, the tie shoe 10 includes a pair of oppositely-disposed projecting portions 84, each of which is integral with one respective side of the upper covering 56 of the tie shoe cover 50. At the distal end of each projecting portion 84 is a grommet or eyelet 86 through which a shoelace 88 can be inserted for tying the tie shoe cover 50 after it has been placed on the tie shoe 10. The various shoe covers 46, 48, and 50 are interchangeable insofar as the Oxford cover 46 can be placed onto the Oxford shoe 12, the Mary Jane shoe 14, and the tie shoe 10. The Mary Jane cover 48 will fit onto the Mary Jane shoe 14 as well as the tie shoe 10; however, the tie shoe cover 50 can only be used with the tie shoe 10.

The foregoing is considered as illustrative only of the principles of the invention. Further, since numerous modifications and changes will readily occur to those skilled in the art, it is not desired to limit the invention to the exact construction and operation shown and described, and, accordingly, suitable modifications and equivalents may be resorted to, falling within the scope of the invention.

What is claimed is:

1. A tap dance shoe with a removable cover conformably fitted on, and concealing, the shoe upper;

the cover being a single piece formed from a stretchable, pliable fabric and having an integral band portion underlying the a shoe's arch;

a toe tap fixed forwardly on a shoe sole;

the cover having an integral forward toe portion wrapped under a forward end of a shoe vamp and terminating on an underside of the shoe as a curved sleeve generally conforming to a curved shape of a forward end of the shoe sole;

a wire shaped as an endless loop and being substantially contained within the sleeve; and the wire having an exposed portion extending laterally against the shoe sole and rearwardly adjacent the toe tap.

2. The tap dance shoe of claim 1 further comprising a pad mounted on the shoe sole rearwardly adjacent the toe tap, the pad and the toe tap having adjacent spaced-apart edges defining a gap therebetween, and the wire's exposed portion being contained within the gap.

* * * * *